United States Patent [19]

Elmgren

[11] 3,933,418

[45] Jan. 20, 1976

[54] PRESS FOR TREATING PRODUCTS UNDER HIGH PRESSURE

[75] Inventor: Staffan Elmgren, Helsingborg, Sweden

[73] Assignee: Allmanna Svenska Elektriska Aktiebolaget, Vasteras, Sweden

[22] Filed: Mar. 17, 1975

[21] Appl. No.: 559,050

[30] Foreign Application Priority Data

May 2, 1974 Sweden ..... 7405837

[52] U.S. Cl. ..... 425/405 H; 425/77

[51] Int. Cl.[2] ..... B30B 11/00; B30B 15/02

[58] Field of Search ..... 425/77, 405 H

[56] References Cited

UNITED STATES PATENTS

| | | | |
|---|---|---|---|
| 3,550,199 | 12/1970 | Landa | 425/405 H X |
| 3,591,903 | 7/1971 | Bowles | 425/405 H X |
| 3,730,666 | 5/1973 | Bowles | 425/405 H |
| 3,832,100 | 8/1974 | Baxendale | 425/405 H X |

*Primary Examiner*—J. Howard Flint, Jr.

[57] ABSTRACT

A press for treatment of material includes a high pressure chamber formed of a vertical high pressure cylinder having end closures projecting into the cylinder and a press stand with a clear opening which is somewhat greater than the length of the high pressure chamber when the end closures are fully inserted. The high pressure cylinder is mounted on a carrying device which can move it into the clear opening of the press stand with gaps between the press stand and the end closures. One of the end closures is constituted by a piston slidable in the high pressure chamber. This piston has an annular portion which is slidable in an annular space formed at the end of the high pressure cylinder. Fluid under pressure can be supplied to the space on the side of the annular projection facing away from the high pressure cylinder to move the piston into the high pressure chamber and holding it there during movement of the high pressure chamber into the press stand, whereafter such pressure fluid can be released.

3 Claims, 4 Drawing Figures

A-A

B-B

PRESS FOR TREATING PRODUCTS UNDER HIGH PRESSURE

BACKGROUND OF THE INVENTION

1. Field of the Invention

The present invention relates to a press with a preferably vertically arranged high pressure chamber having a high pressure cylinder, end closures projecting into this cylinder and a press stand to take up the axial forces exerted on the end closures by a medium under high pressure. Presses of the type mentioned are used, among other things, for isostatic compression of powder bodies, resistance elements, and the like at pressures in the region of 1,000 — 10,000 bar. The cylinder is charged outside the press stand with components to be treated, and then inserted in the press stand and supplied with pressure medium. The press stand is then removed after treatment and the cylinder is emptied outside the press stand.

2. The Prior Art

With presses of this type, the high pressure chamber with the closures completely inserted must have a shorter length than the clear opening of the press so that the clearance necessary for insertion and withdrawal of the chamber is obtained between the end closures and the press. When the pressure in the chamber is increased, the end closures are first forced out until they come into contact with support surfaces in the press stand and then move only as far as the support surface yields under the load. Because of the friction between the closures and the cylinder, the pressure chamber is still held between the support surfaces of the press stand with a considerable force even when the pressure is removed. This complicates removal of the pressure chamber. The end closures must therefore be returned to their innermost positions in the cylinder so that the clearance between the end closures and the support surfaces which is suitable for moving the press is again obtained. A press with appliances for achieving this insertion of end closures is described in U.S. Pat. No. 3,550,199.

In the known press, a piston was built into the end closure or the support of a press stand. The cross-section, taking up the load, in the end closure just below the pressure chamber space was thus reduced, as well as the load-transmitting contact surface of the end closure and the press stand. At relatively low compression pressure, this involves little or no inconvenience. At very high working pressures, for example at working pressures of more than 4000 bar, this involves a considerable inconvenience from the point of view of strength. Similarly, the suspension of a supporting ring for the end closure by means of spring units involves no problems when the diameter of the pressure cylinder is small, but a considerable problem when the diameter of the cylinder is large. There are certain problems in accommodating sufficiently strong or sufficiently many spring units. The new operating mechanism means a simplification which makes the manufacture simpler and less expensive, and which makes it possible to use simpler constructional material.

SUMMARY OF THE INVENTION

In the press according to the invention, the mechanism which returns the end closures to their innermost positions is constructed in a new and improved manner.

According to the invention, the lower end closure is constructed so that it forms a piston running in an operating cylinder connected to the high pressure cylinder. The outer part of the lower end closure is constructed with two separate diameters which are surrounded by a ring connected to the high pressure cylinder, the internal diameters of said ring being adjusted to said diameters. An annular shoulder projection is formed on the end closure and the ring at the transition between the different diameters. The shoulder on the end closure forms an annular piston surface. An annular cylinder space is formed between said shoulders, the smaller diameter of the end closures and the larger diameter of the ring. This space is supplied with pressure medium for the insertion of the end closure on the line of the shoulder facing away from the high pressure cylinder.

There is thus provided a releasable means for holding the piston on its innermost position.

BRIEF DESCRIPTION OF THE DRAWINGS

The invention will be described in more detail with reference to the accompanying drawings.

DESCRIPTION OF THE PREFERRED EMBODIMENTS

Figure 1:
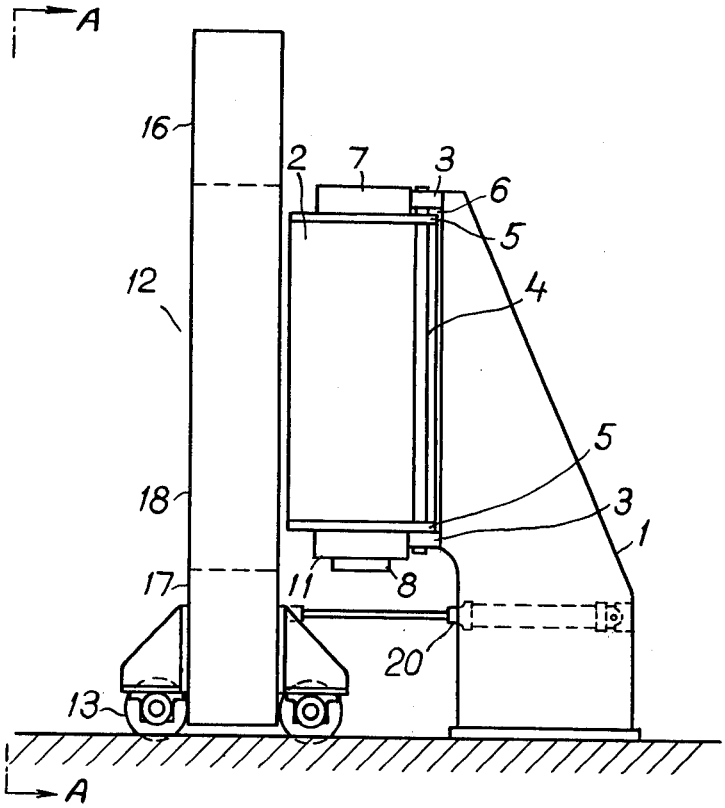
FIG. 1 shows a side view of a press having a high pressure chamber which is supported by a stationary pillar and a movable press stand positioned at the side of the high pressure chamber.
Figure 3:
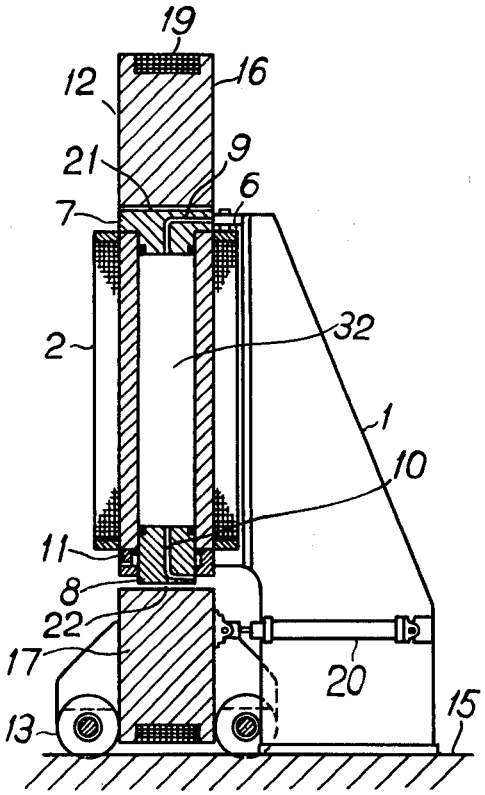
FIG. 3 is a section on the line B — B in FIG. 2

In the figures, 1 designates a stand supporting a high pressure cylinder 2. The stand is provided with two lugs 3 in which a rod 4 is inserted. The cylinder 2 is provided with two lugs 5 having bearing surfaces accommodating the rod 4. The distance between the outer surfaces of the lugs 5 is less than the distance between the inner surfaces of the lugs 3. This means that the cylinder is axially displaceable by a distance which is just as long as the difference in distance between said surfaces. The cylinder normally rests on the lower lug 3, a gap 6 thus being formed between the upper lugs 3 and 5, which makes it possible to adjust the vertical position of the cylinder somewhat in relation to the clear opening of the press stand. The cylinder 2 is closed by an upper end closure 7 and a lower end closure 8 projecting somewhat into the cylinder. The upper end closure is provided with a channel 10 for supply of pressure medium from a pressure medium in a cylinder which is formed by a ring 11. The press contains a displaceable press stand 12 which is supported by wheels 13 running on rails 14 set into the floor 15. The press stand is of the type consisting of an upper yoke 16, a lower yoke 17, and a pair of spacers 18 which are held together by a prestressed strip sheath 19. The press stand is displaced between the positions shown in FIGS. 1 and 3 by means of an operating cylinder 20. The opening of the press stand is somewhat higher than the distance between the end surfaces of the completely inserted end closures. The cylinder is fixed at such a height that the clearances 21 and 22 between the yoke of the press stand and the end closures of the cylinder are approximately of the same size.

Figure 4:
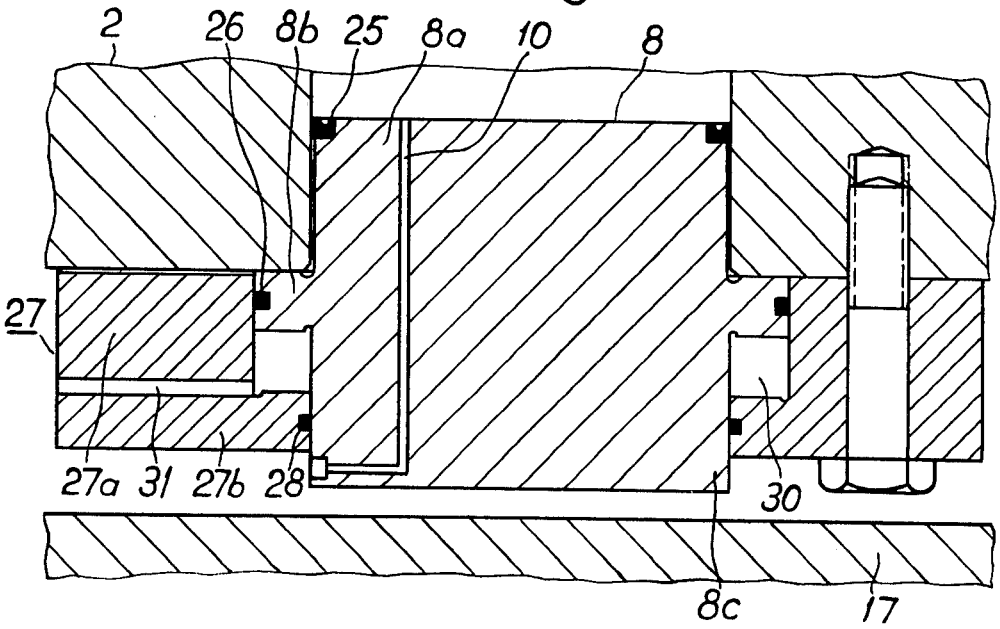
FIG. 4 is a section on a larger scale through the lower part of the high pressure chamber cylinder, the lower end closure and the upper part of the lower yoke of the press stand.
Figure 2:
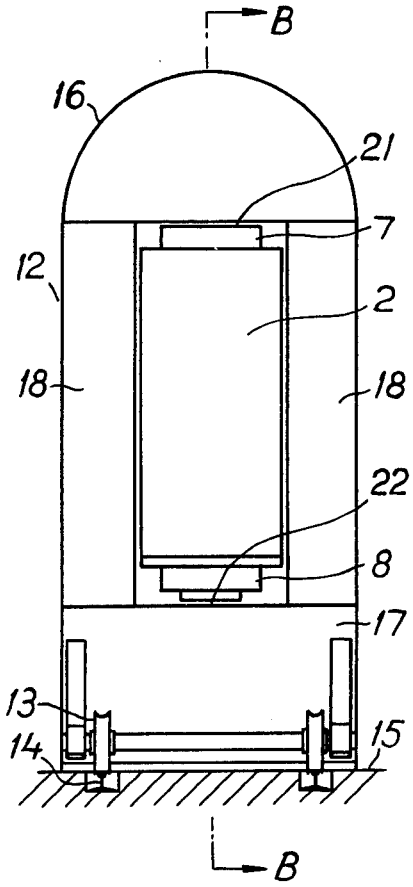
FIG. 2 is a side view.

As shown in FIG. 4, the lower end closure 8 is formed with an inner part 8*a* with a diameter to fit in the cylinder 2 and with a slot for a seal 25, a middle portion 8*b* with a slot for a seal 26 and an outer portion 8*c* having a smaller diameter than the middle portion 8*b*. A ring 27 is fastened to the cylinder 2 by bolts. The part 27*a* of the ring located nearest to the high pressure cylinder 2 has an inner diameter fitting the middle portion 8*b* of the end closure, and its lower part 27*b* has an internal diameter fitting the outer portion 8*c* of the end closure. In the part 27 there is a slot for a seal 28. The lower end closure 8 thus forms an annular piston and the ring 27 forms a cylinder in which the annular piston runs. The middle portion 8*b* of the end closure 8 forms an annular piston surface. The space 30 formed by the portions 8*b* and 8*c* of the end closure 8 and the cylindrical surface of the ring 27 in the part 27*a* and the inner plane surface of the part 27*b* communicates with a pressure medium source (not shown) through a channel 31 and conduits and valves (not shown). In the part 27*a* there is a radial channel 33 through which the space between the high pressure cylinder 2 and the part 8*b* communicate with the atmosphere outside the cylinder 2.

The press operates in the following manner. The working space 32 is charged with material, and the upper end closure 7 is inserted into the cylinder 2 so that a closed pressure chamber is formed, after which the press stand is displaced from the position shown in FIG. 1 to the position shown in FIG. 3. During the movement of the stand, the space 30 is kept filled with pressure medium so that the lower end closure is held in its upper or innermost position shown in FIG. 4, so that its lower surface is held at a somewhat higher level than the surface of the lower yoke 17, a gap 22 being provided which allows the stand 12 to be displaced to the position shown in FIG. 3. The upper end closure 7 is inserted into its innermost position so that a gap 21 is formed between this end closure and force-absorbing surface of the upper yoke 16 of the press stand. When the press stand is in the position shown in FIG. 3, the cylinder space 30 is put into communication with a collecting container for pressure medium by way of a valve, so that the pressure can freely flow out of the space 30. By the pressure of the material and pressure medium in the pressure chamber space 32, the lower end closure 8 is pressed downwards till it makes contact with the yoke 17. Pressure medium is now introduced through the channel 10 in the lower end closure 8 in the space 32, which in a first stage is released through the channel 9 in the upper end closure 7. When a valve in the release channel 9 is closed, the pressure in the pressure chamber is raised to the intended treatment level. When the treatment is finished, the pressure chamber is put into connection with a collecting container for pressure medium. At the same time, the lower end closure is raised to its inner position by introducing pressure medium in the cylinder space 30, thus obtaining an upwardly directed force on the annular piston surface of the part 8*b*. The upper end closure 7 is pressed into its inner position by means of a manipulator (not shown) for handling the end closure. Gaps 21 and 22 are thus again formed between the end closures 7 and 8 and the yokes 16 and 17, so that the stand 12 can be returned unimpededly to the position shown in FIG. 1, the upper end closure can be removed, the treated material can be withdrawn and the pressure chamber can be charged anew.

I claim:

1. Press for treating material with a high pressure, comprising a high pressure chamber including a vertical high pressure cylinder (2) having end closures (7,8) projecting into the cylinder (2), a press stand (12) with a clear opening which is somewhat greater than the length of the high pressure chamber when the end closures (7,8) are fully inserted, which stand (12) surrounds the high pressure chamber during the pressing operation and takes up the axial forces which a pressure medium in the pressure chamber exerts on the end closures (7,8), carrying members (1, 3, 4, 5) for the pressure chamber for holding said chamber in such a position that gaps (21,22) are formed between the press stand (12) and the end closures (7,8) of the chamber when the end closures are inserted to their innermost positions in the cylinder, in which a ring (27) is connected to one end of the high pressure chamber and one of the end closures (8) comprises a piston slidable within said ring.

2. Press according to claim 1 having releasable means (8*b*, 30) for holding the piston in its innermost position.

3. Press according to claim 1, having means at such end of the high pressure cylinder forming an annular space (30) around the piston, the piston having an annular enlargement (8*b*) slidable in said annular space, and releasable means (31) to supply pressure fluid to said annular space on the side of the enlargement facing away from the high pressure cylinder.

* * * * *